US006182416B1

(12) United States Patent
Brackin

(10) Patent No.: US 6,182,416 B1
(45) Date of Patent: Feb. 6, 2001

(54) TILT-UP WALL PANEL CONSTRUCTION METHOD AND FORM BLOCKS

(76) Inventor: Thomas L. Brackin, Triple Star Construction, Inc., 558 Birch St., #5, Lake Elsinore, CA (US) 92530

( * ) Notice: Under 35 U.S.C. 154(b), the term of this patent shall be extended for 0 days.

(21) Appl. No.: 09/360,067

(22) Filed: Jul. 23, 1999

(51) Int. Cl.[7] ..... E06B 1/00
(52) U.S. Cl. ..... 52/745.09; 264/297.9
(58) Field of Search ..... 52/745.09, 745.2, 52/125.4; 264/297.9, 334, 34, 297.8

(56) References Cited

U.S. PATENT DOCUMENTS 4,042,205 * 8/1977 Herrell ..... 52/745.09 X
4,104,356 * 8/1978 Deutsch et al. ..... 264/297.9
4,393,568 * 7/1983 Navarro ..... 264/334 X
4,542,613 * 9/1985 Leyte-Vidal ..... 52/745.09 X
4,659,057 * 4/1987 Felter ..... 249/97
5,096,155 * 3/1992 Fitzgerald ..... 249/219.1
5,489,468 * 2/1996 Davidson ..... 52/717.04 X
5,656,194 * 8/1997 Zimmerman ..... 249/160

* cited by examiner

*Primary Examiner*—David M. Purol
(74) *Attorney, Agent, or Firm*—Loyal McKinley Hanson

(57) ABSTRACT

A method for fabricating a tilt-up concrete wall panel atop a concrete slab includes reinforcing a form atop the concrete slab with at least one stick-on block to avoid making nail or screw holes in the concrete slab. The block is removably secured to the slab adhesively. One common form block includes an injection molded body of material with a stick-on base portion and two upstanding flange portions that define a channel adapted to receive a common form member. A preferred edge form block is triangularly shaped.

11 Claims, 2 Drawing Sheets

18
10D
10C
10B
12
15
2
2
10A
13
11E
17
11D
14
19
11C
11B
4
4
16
11A
32

TILT-UP WALL PANEL CONSTRUCTION METHOD AND FORM BLOCKS

BACKGROUND OF THE INVENTION

1. Technical Field

This invention relates generally to building construction procedures and equipment, and more particularly to a method and form blocks for constructing tilt-up concrete wall panels.

2. Description of Related Art

Tilt-up concrete wall panels facilitate building construction. Workers fabricate them at the building site and then tilt them up into position to form the walls. Doing so greatly simplifies construction. It also introduces some unique problems that need to be overcome.

Consider a typical tilt-up wall panel measuring about 35 feet by 24 feet by 8 inches thick. Workers fabricate it at the building site after the concrete floor slab has been poured by building it atop the floor slab. First, they place a suitable bond breaker release agent on the slab. Next, they build forms on the slab and set rebar or other reinforcing. Then, they pour concrete. After the concrete has cured, they break off the forms and tilt the wall panel up into position where it is suitably secured.

One major problem concerns the forms. In building the forms, workers nail (or screw) the individual form members to the concrete floor slab. In the case of nails, they drill quarter-inch holes in the concrete floor slab at spaced apart intervals and then drive two sixteen-penny nails through the forms into each hole. That holds the forms in place, but an array of nail holes results in the concrete floor slab. Although workers usually patch the holes, the hole locations are still visible and very undesirable to many developers and building specification writers. So, construction workers need a way to overcome this concern.

SUMMARY OF THE INVENTION

This invention addresses the concern outlined above by providing stick-on form reinforcing blocks (i.e., form blocks) for holding the form members in position on the concrete floor slab. Workers stick the form blocks to the concrete floor slab at desired spaced apart positions and then nail them to the form members. That means no nail holes in the concrete floor slab . . . no holes to drill and no holes to patch.

To paraphrase some of the more precise claim language subsequently presented, a method for fabricating a concrete wall panel atop a concrete slab includes the steps of providing a form atop the concrete slab, providing a plurality of blocks adapted to reinforce the form, securing the blocks to the concrete slab in reinforcing positions adjacent the form, pouring concrete in the form, and allowing the concrete to cure to thereby produce the concrete wall panel. The construction crew then tilts the concrete wall panel upwardly from the concrete slab into a desired position and removes the blocks from the concrete slab.

According to a major aspect of the invention the step of providing a plurality of blocks includes providing at least one block that is adapted to be secured to the concrete slab adhesively, preferably with an adhesive that comes already attached to the block. In line with the foregoing, a block for reinforcing a form member atop a concrete slab includes a body of material having an overall height no greater than the predetermined thickness specified for the concrete wall panel. The body of material has an upstanding flange portion for placement alongside the form member and a base portion for placement atop the concrete slab. Adhesive means are provided for securing the base portion to the concrete slab adhesively.

One common form block for reinforcing a common form member includes injection molded first and second upstanding flange portions that define a channel adapted to receive the common form member. One edge form block for reinforcing an edge form member has a triangular shape. The following illustrative drawings and detailed description make the foregoing and other objects, features, and advantages of the invention more apparent.

DESCRIPTION OF THE PREFERRED EMBODIMENTS

Figure 1:
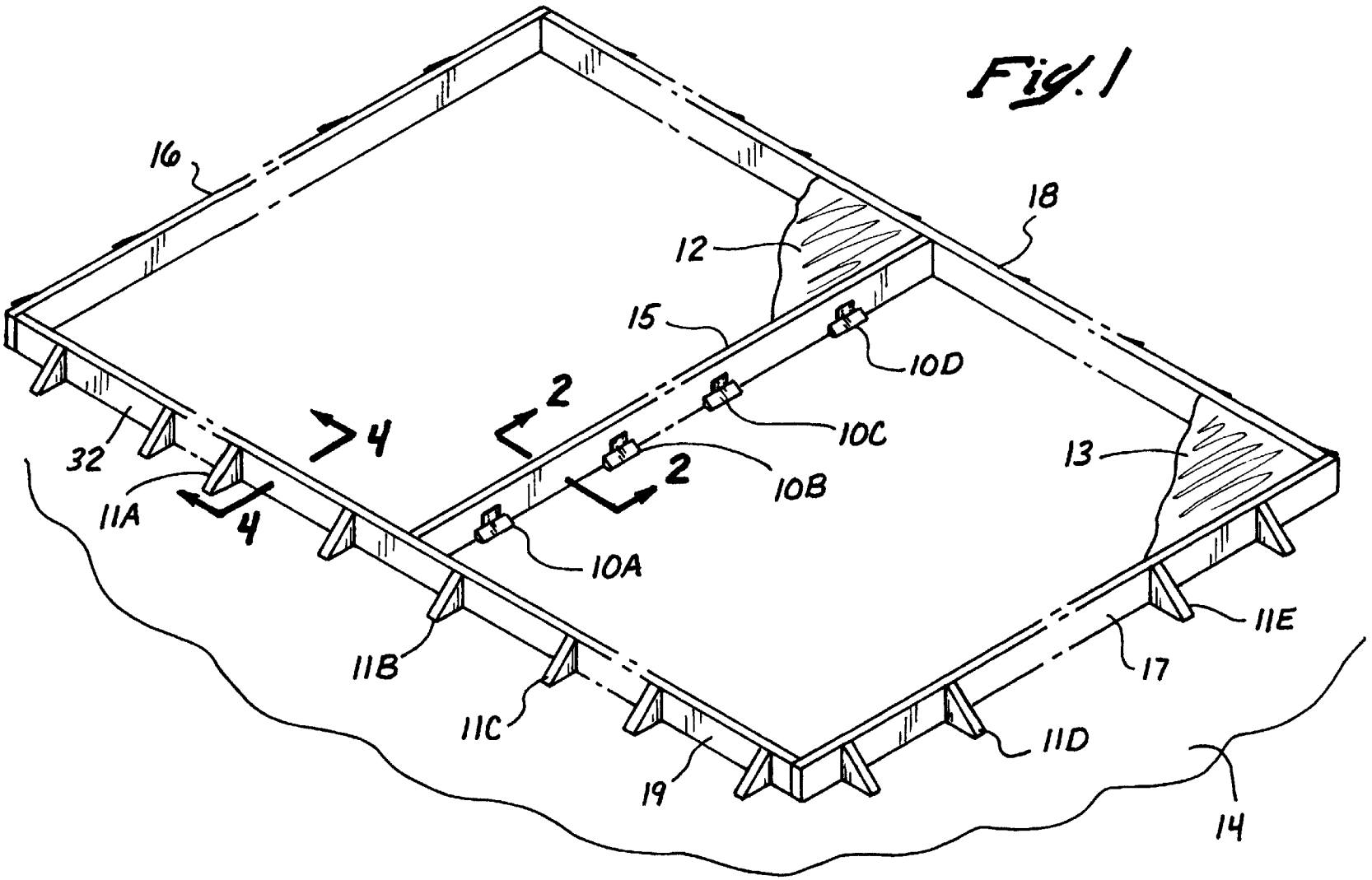
FIG. 1 of the drawings is an isometric view of a form for constructing two concrete tilt-up wall panels, showing the form reinforced atop a concrete floor slab with stick-on form blocks constructed according to the invention.

The drawings show various aspects of the methodology, stick-on common form blocks 10A, 10B, 10C and 10D (FIGS. 1), and stick-on edge form blocks 11A through 11E (FIGS. 1 and 4) used to fabricate first and second concrete wall panels 12 and 13 atop a concrete floor slab 14 (FIG. 1) according to the invention. Only the four common form blocks 10A through 10B are visible in FIG. 1 because the common form member 15 they are reinforcing is foreshortened in FIG. 1. Four edge form members 16, 17, 18, and 19 are also foreshortened and only the five edge form blocks 11A through 11E are designated in order to keep FIG. 1 uncluttered. In addition, only small portions of the concrete wall panels 12 and 13 are shown in FIG. 1 for illustrative convenience although the panel 12 actually fills the space between the common form member 15 and the edge form members 16, 17, and 18, while the panel 13 actually fills the space between the common form member 15 and the edge form members 17, 18, and 19.

Fabrication of the wall panels 12 and 13 includes the steps of providing a form as shown in FIG. 1 (i.e., the combination of the common form member 15 and the edge form members 16–19). It is built atop the concrete slab 14 by assembling the common form member 15 and the edge form members 16–19. In building the form, the construction crew reinforces the common form member 15 with common form blocks (including the common form blocks 10 through 10D) and it reinforces the edge form members 16–19 with edge form blocks (including the edge form blocks 11A through 11E). Next, the construction crew pours concrete in the form and allows the concrete to cure to thereby produce the concrete wall panels 12 and 13. After that, the crew breaks the edge form members 16–19 away from the wall panels 12 and 13 and tilts the wall panels 12 and 13 upwardly from the concrete slab 14 into desired vertically disposed positions using a crane or other suitable means (not shown). The form blocks 10 and 11 are removed from the concrete slab 14 as part of the procedure.

According to the major aspect of the invention, the step of providing form blocks includes providing at least one block that is adapted to be secured to the concrete slab adhesively. Preferably, all the form blocks are so adapted. They stick on adhesively for later removal without the need for nail or screw holes in the concrete slab 14.

Figure 2:
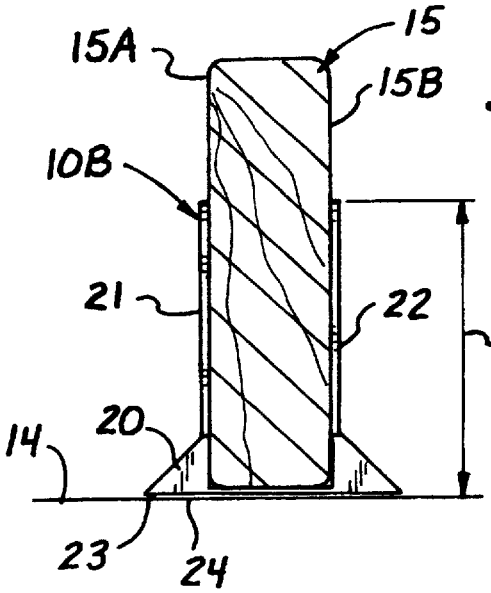
FIG. 2 is an enlarged view of a first or common form block that is used to reinforce the common form member disposed between the two wall panels.
Figure 3:
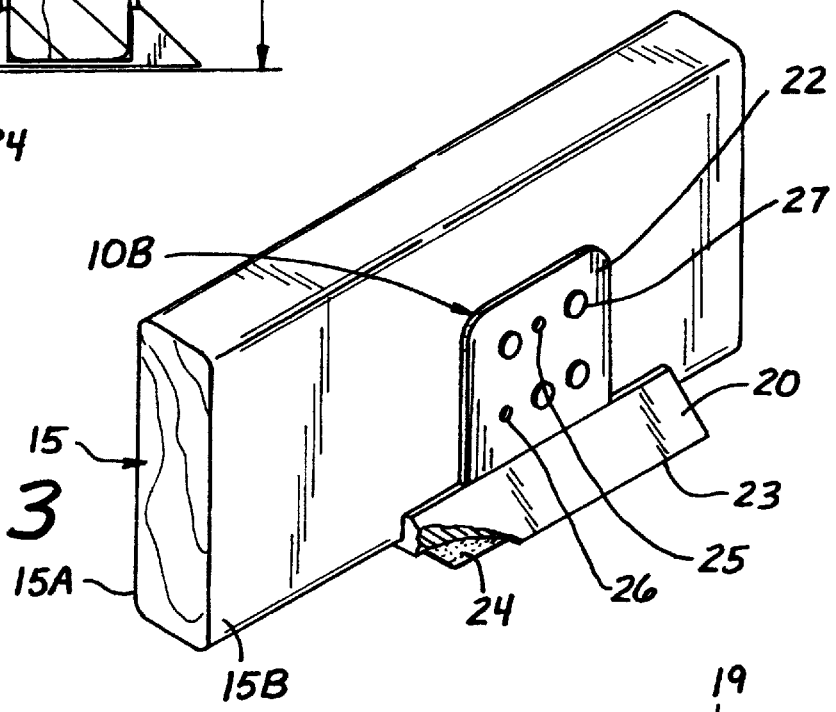
FIG. 3 is an isometric view of the common form block.

FIGS. 2 and 3 show further details of the common form block 10B reinforcing the common form member 15. The common form blocks are all similar, and so only the common form block 10B is discussed in further detail. It includes a body of material (e.g., injection molded plastic) having an overall height above the concrete slab (depicted by the letter A in FIG. 2) that is no greater than the predetermined thickness of the wall panel being fabricated. In other words, it does not extend upwardly beyond the common form member 15 it reinforces.

The illustrated common form member 15 represents a length of two-by-six lumber. The common form member 15 may have any of various other sizes without departing from the inventive concepts disclosed (e.g., two-by-four, two-by-ten, two-by-twelve, and so forth). The width of the common form member 15 corresponds to the desired thickness of the wall panels being fabricated. The illustrated common form block 10B is designed to work with forms built with two-by-four and larger lumber, and so its overall height is no greater than the corresponding predetermined thickness of the wall panel fabricated with forms built of two-by-four lumber (approximately 3.5 inches). Thus, it works for thicker walls also.

The common form block 10B (i.e., the body of material) includes a base portion 20 for placement atop the concrete slab 14, and first and second upstanding flange portions 21 and 22 for placement alongside opposite sides of the common form member 15 where they have a reinforcing relationship to the common form member 15. The flange portions 21 and 22 define a channel between them that is sized to receive the common form member 15. The channel is adapted to receive the common form member 15 in the sense that the spacing between the first and second flange portions 21 and 22 is just slightly larger than the thickness of the common form member 15.

With the common form member 15 disposed between the first and second flanges 21 and 22, the common form member 15 rests on the base portion 20. A downwardly facing surface 23 of the base portion 20 faces the concrete slab 14, while an adhesive material 24 attached to the downwardly facing surface 23 (FIGS. 2 and 3) sticks to the concrete slab 14 to hold the common form block 10B in position without the need for nail or screw holes in the concrete slab 14.

The adhesive material 24 may take the form of any of various adhesive materials suitable for adhesively securing the common form block 10B to the concrete slab 14 (e.g., double sided adhesive tape or the adhesive available from 3-M Company that is used for wall panel detail strips). It serves the function of securing the base portion 20 to the concrete slab 14 adhesively. As a further idea of size, the upstanding flanges 21 and 22 measure about ⅛-inch thick. The thickness of the base portion 21 beneath the common form member 15 is also about ⅛-inch thick, and the adhesive material 24 has the same order of thickness depending on the precise material used. Of course, those dimensions may vary within the scope of the claims subsequently presented. In addition, the upstanding flanges 21 and 22 may include holes (e.g., the holes 25 and 26 in FIG. 3) to facilitate nailing of the upstanding flanges to the common form member 15 (only one nail 27 of four illustrated nails being designated in FIG. 3). Based upon the above and subsequent descriptions and the claims, one of ordinary skill in the art can readily practice the invention.

Figure 4:
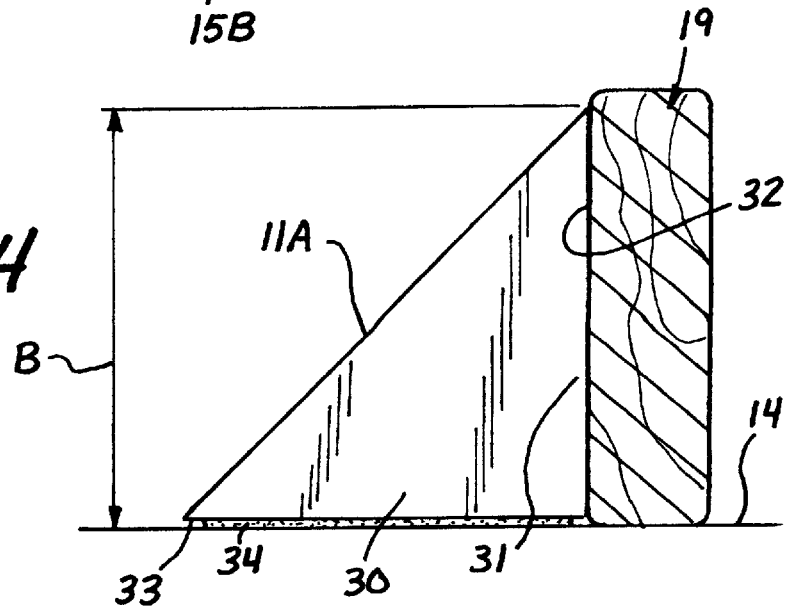
FIG. 4 is a side view of a second or edge form block that is used to reinforce an edge form member that extends along an edge of the panels.

FIG. 4 shows further details of the edge form block 1 1A reinforcing the edge form member 19. The edge form blocks are all similar, and so only the edge form block 11A is discussed in further detail. It includes a body of material (e.g., injection molded plastic, wood, or other material) having an overall height above the concrete slab (depicted by the letter B in FIG. 4) that is no greater than the predetermined thickness of the wall panel being fabricated. It does not extend upwardly beyond the edge form member 19 it reinforces.

The illustrated edge form member 19 represents a length of two-by-six lumber, although it may have any of various other sizes without departing from the inventive concepts disclosed. The width of the edge form member 19 corresponds to the desired thickness of the wall panels being fabricated. The illustrated edge form block 11A is designed to work with forms built with two-by-six and larger lumber, and so its overall height is no greater than the corresponding predetermined thickness of the wall panel fabricated with forms built of two-by-six lumber (approximately 5.5 inches). Thus, it works for thicker walls also. Of course, it can be sized for use with two-by-four lumber if desired.

The edge form block 11A (i.e., the body of material) includes a base portion 30 for placement atop the concrete slab 14 and a form facing portion 31 for placement in a reinforcing relationship to an outwardly facing side 32 the edge form member 19 as illustrated. The illustrated edge form block 11A is triangularly shaped, but other shapes may be used within the scope of the claims and without departing from the inventive concepts disclosed. With the edge form block 11A disposed in a reinforcing relationship to the edge form member 19 as illustrated, a downwardly facing surface 33 of the base portion 30 faces the concrete slab 14, while an adhesive material 34 attached to the downwardly facing surface 33 sticks to the concrete slab 14 to hold the common form block 11A in position. The adhesive material 24 may take the form of any of various adhesive materials as described above for the common form block 11A. It serves the function of securing the base portion 30 to the concrete slab 14 adhesively without the need for nail or screw holes in the concrete slab 14.

Thus, the invention provides a method and stick-on form reinforcing blocks for holding form members in position on the concrete floor slab for purposes of fabricating a tilt-up wall panel. Workers stick the form blocks to the concrete floor slab at desired spaced apart positions and then nail them to the form members. That means no nail holes in the concrete floor slab . . . no holes to drill and no holes to patch. Although exemplary embodiments have been shown and described, one of ordinary skill in the art may make many changes, modifications, and substitutions without necessarily departing from the spirit and scope of the invention. The length of the common form blocks may be changed, for example, from the illustrated four to six-inch length (preferably no more than a foot long nor less than an a couple inches).

What is claimed is:

1. A method for fabricating a concrete wall panel atop a concrete slab, comprising:

providing a form atop the concrete slab;

providing a plurality of blocks adapted to reinforce the form;

securing the blocks to the concrete slab in reinforcing positions adjacent the form;

pouring concrete in the form allowing the concrete to cure to thereby produce the concrete wall panel;

tilting the concrete wall panel upwardly from the concrete slab into a desired position; and removing the blocks from the concrete slab;

wherein the step of securing the blocks to the concrete slab includes securing the blocks to the concrete slab adhesively using adhesive material between the blocks and the concrete slab that is adapted to function as means for securing the blocks to the concrete slab adhesively without the need for securing the blocks to the concrete slab with fasteners such as nails and screws extending through the blocks into holes in the concrete slab.

2. A method as recited in claim 1, wherein:

the step of providing a form includes providing a form having a common form member; and the step of providing at least one block includes providing a common form block having at least one upstanding flange portion adapted to be placed against the common form member and a base portion adapted to be secured to the concrete slab adhesively.

3. A method as recited in claim 1, wherein:

the step of providing a form includes providing a form having a common form member; and the step of providing at least one block includes providing a common form block having at least two upstanding flange portions that define a channel adapted to receive the common form member, and a base portion adapted to be secured to the concrete slab adhesively.

4. A method as recited in claim 1, wherein:

the step of providing a form includes providing a form having an edge form member; and the step of providing at least one block includes providing an edge form block having a sideways facing portion adapted to be placed against the first edge form member and a downwardly facing portion adapted to be secured to the concrete slab adhesively.

5. A method as recited in claim 1, further comprising the step of nailing the block to the form member.

6. A block for reinforcing a form member atop a concrete slab for purposes of fabricating a concrete wall panel of predetermined thickness atop the concrete slab, the block comprising:

a body of material having an overall height no greater than the predetermined thickness of the concrete wall panel;

an upstanding flange portion of the body of material for placement alongside the form member;

a base portion of the body of material for placement atop the concrete slab;

a downwardly facing surface of the base portion; and an adhesive material attached to the base portion of the of the body of material, which adhesive material is adapted to function as means for securing the base portion to the concrete slab adhesively without the need for securing the base portion to the concrete slab with fasteners such as nails and screws extending through the base portion into a hole in the concrete slab.

7. A block as recited in claim 6, wherein the body of material includes an injection molded plastic material.

8. A block as recited in claim 6, wherein the body of material includes two upstanding flange portions that define a channel adapted to receive a common form member.

9. A block as recited in claim 6, wherein the upstanding flange portion defines at least one nail hole through which a user can drive a nail for purposes of nailing the upstanding flange portion to the form member.

10. A common form block for reinforcing a common form member atop a concrete slab for purposes of fabricating a wall panel of predetermined thickness, the common form block comprising:

a body of material having an overall height no greater than the predetermined thickness of the concrete wall panel;

first and second upstanding flange portions of the body of material that define a channel adapted to receive the common form member;

a base portion of the body of material for placement atop the concrete slab;

a downwardly facing surface of the base portion; and an adhesive material attached to the base portion of the of the body of material, which adhesive material is adapted to function as means for securing the base portion to the concrete slab adhesively without the need for securing the base portion to the concrete with fasteners such as nails and screws extending through the base portion into a hole in the concrete slab.

11. An edge form block for reinforcing an edge form member atop a concrete slab for purposes of fabricating a concrete wall panel of predetermined thickness, the edge form block comprising:

a body of material having an overall height no greater than the predetermined thickness of the concrete wall panel;

an upstanding flange portion of the body of material having a sideways facing surface for placement against the edge form member;

a base portion of the body of material for placement atop the concrete slab;

a downwardly facing surface of the base portion; and an adhesive material attached to the base portion of the of the body of material, which adhesive material is adapted to function as means for securing the base portion to the concrete slab adhesively without the need for securing the base portion to the concrete slab with fasteners such as nails and screws extending through the base portion into a hole in the concrete slab.

* * * * *